US007461525B2

(12) United States Patent
Wilson

(10) Patent No.: US 7,461,525 B2
(45) Date of Patent: Dec. 9, 2008

(54) TILE SPONGE WASHING AND CONDITIONING APPARATUS

(76) Inventor: Rodney W. Wilson, 3873 5th Dr., Wisconsin Dells, WI (US) 53965

( * ) Notice: Subject to any disclaimer, the term of this patent is extended or adjusted under 35 U.S.C. 154(b) by 539 days.

(21) Appl. No.: 11/173,662

(22) Filed: Jul. 1, 2005

(65) Prior Publication Data

US 2006/0000246 A1 Jan. 5, 2006

Related U.S. Application Data

(63) Continuation-in-part of application No. 10/799,833, filed on Mar. 13, 2004.

(51) Int. Cl.
*D06F 15/00* (2006.01)

(52) U.S. Cl. ..... 68/22 R; 68/43; 68/84; 68/99; 68/175; 15/262

(58) Field of Classification Search ..... 68/22 R, 68/31, 43, 52, 84, 85, 94, 97, 99, 175, 200; 15/40, 262
See application file for complete search history.

(56) References Cited

U.S. PATENT DOCUMENTS 3,646,785 A 3/1972 Arioli
3,681,950 A 8/1972 Fleissner
4,034,389 A * 7/1977 Huss ..... 396/619
4,159,632 A * 7/1979 Grantham ..... 68/9
4,226,598 A 10/1980 Schiffer
4,226,641 A 10/1980 Bode et al.
4,368,627 A 1/1983 Bode et al.
5,259,560 A 11/1993 Dyer
5,459,902 A 10/1995 Hino et al.
5,511,471 A 4/1996 Foote
6,327,740 B1 * 12/2001 Baltazar ..... 15/261

FOREIGN PATENT DOCUMENTS

DE 3121362 A1 12/1982

* cited by examiner

*Primary Examiner*—Joseph L Perrin
(74) *Attorney, Agent, or Firm*—David J. Archer

(57) ABSTRACT

A tile sponge washing and conditioning apparatus is disclosed for washing in water a sponge used during a ceramic tile grouting operation. The apparatus includes a frame for disposition thereof within the water. The frame includes a first wall and a second wall which is disposed spaced from the first wall. A first roller has an axis of rotation which extends through the walls and a second roller has a rotational axis which also extends through the walls. The rollers cooperate with each other to define therebetween a pathway for the passage therethrough of the sponge to be washed and conditioned. The arrangement is such that when the rollers are counter rotated relative to each other, the sponge is squeezed and driven through the passageway so that the sponge is washed and conditioned by the water during passage of the sponge through the passageway.

16 Claims, 7 Drawing Sheets

TILE SPONGE WASHING AND CONDITIONING APPARATUS

CROSS REFERENCE TO RELATED APPLICATION

The present application is a continuation in part of co-pending patent application U.S. Ser. No. 10/799,833 filed Mar. 13, 2004. All the disclosure of U.S. Ser. No. 10/799,833 is incorporated herein by reference.

FIELD OF THE INVENTION

1. Background of the Invention

The present invention relates to a tile sponge washing and conditioning apparatus. More specifically, the present invention relates to a tile sponge washing and conditioning apparatus for washing in water a sponge used during a ceramic tile grouting operation.

2. Background Information

A tile laying operation includes laying the tiles onto a layer of adhesive. When the adhesive has set, a grouting compound is applied to the tiles for filling the spaces between adjacent tiles. Excess grout must be removed from the tiles before the grout hardens. In order to remove such excess grout, a dampened sponge is applied to the surface of the tile and wiped across the upper surface of the tile for removing the excess grout from the tiles. The initial process of removing excess grout entails the removal of a considerable amount of grout. Therefore, it is essential that the sponge be frequently immersed into clean water to wash away such excess grout from the sponge. Typically, the sponge is submerged in a bowl of water and is hand squeezed in order to release the grout on the sponge into the bowl of water.

The aforementioned process is time consuming because it is essential that the sponge be frequently cleaned in order to progressively remove the excess grout from the tiles. Also, because the grout has a damaging effect on the skin, the tiler should wear protective gloves when washing and conditioning the sponge in the bowl of water.

The apparatus according to the present invention overcomes the aforementioned problems by the provision of an apparatus which is at least partially immersed in a container of water. In operation of the apparatus, a sponge to be cleaned and conditioned is inserted between counter rotating rollers which feed the sponge through the water in the container and progressively squeeze and release the sponge so that the excess grout is removed from the sponge into the water as the sponge progresses through the apparatus. When the sponge emerges from the apparatus, the sponge has been thoroughly washed and conditioned and is ready for further use on the surface of the tiles for removing further excess grout therefrom. Also, while one sponge is being washed by the apparatus of the present invention, another sponge previously washed and conditioned is used in the removal of excess grout so that no time is wasted waiting for a sponge to be cleaned.

The apparatus according to the present invention cuts down on the time needed to complete a tiling project. Also, the apparatus protects a tiler's hands from the damage caused by immersing the tiler's hands in a bowl of sponge washing water.

Therefore, a primary feature of the present invention is the provision of a tile sponge washing and conditioning apparatus for washing in water a sponge used during a ceramic tile grouting operation that overcomes the problems associated with the prior art arrangements.

Another feature of the present invention is the provision of a tile sponge washing and conditioning apparatus that reduces the time required to complete a tiling project.

A further feature of the present invention is the provision of a tile sponge washing and conditioning apparatus that protect the tiler's hands from the damage caused by immersion of a tiler's hands in a bowl of water used to wash grout away from a sponge.

Other features and advantages of the present invention will be readily apparent to those skilled in the art by a consideration of the detailed description of a preferred embodiment of the present invention contained herein.

SUMMARY OF THE INVENTION

The present invention relates to a tile sponge washing and conditioning apparatus for washing in water a sponge used during a ceramic tile grouting operation. The apparatus includes a frame for disposition thereof within the water. The frame includes a first wall and a second wall which is disposed spaced from the first wall. A first roller has an axis of rotation which extends through the walls and a second roller has a rotational axis which also extends through the walls. The rollers cooperate with each other to define therebetween a pathway for the passage therethrough of the sponge to be washed and conditioned. The arrangement is such that when the rollers are counter rotated relative to each other, the sponge is squeezed and driven through the passageway so that the sponge is washed and conditioned by the water during passage of the sponge through the passageway.

In a more specific embodiment of the present invention, the frame is fabricated from stainless steel.

Also, the first wall is of planar configuration, the first wall having a first and a second edge, a top and a bottom edge and an inner and an outer surface;

Furthermore, the second wall is also of planar configuration, the second wall having a first and a second side, a top and a bottom end and an inner and an outer face, the second wall being disposed parallel relative to the first wall.

More specifically, the first wall includes a first ear which extends from the first edge. Also, a second ear extends from the second edge.

The second wall includes a first extension which extends from the first side and a second extension which extends from the second side.

Moreover, a container is provided for containing the water. The container defines a rim for supporting the ears and the extensions such that when the ears and extensions are being supported by the rim, the rollers are disposed within the water contained within the container.

Additionally, the frame includes a first reinforcing member which extends between the first ear and the first extension. A second reinforcing member extends between the second ear and the second extension such that the reinforcing members maintain the first and second walls in a spaced parallel disposition relative to each other.

The first roller includes a hub which is disposed coaxially relative to the axis of rotation. The hub extends through the walls such that the walls bearingly support the hub for rotation of the hub relative to the walls. Also, the hub has a first and a second end.

More particularly, a first collar defines a peripheral edge, the first collar being secured to the first end of the hub for rotation with the hub.

Also, a second collar defines a further peripheral edge, the second collar being secured to the second end of the hub for rotation with the hub. Moreover, the collars are disposed between the walls.

A plurality of sponge engaging members extend between the collars. The sponge engaging members are spaced relative to each other along and adjacent to the peripheral edges of the collars. The arrangement is such that when the first roller rotates, the sponge engaging members squeeze and condition the sponge.

Additionally, the second roller includes an axle which is disposed coaxially relative to the rotational axis. The axle extends through the walls such that the walls bearingly support the axle for rotation of the axle relative to the walls. Also, the axle has a first and a second extremity.

A first flange defines a periphery, the first flange being secured to the first extremity of the axle for rotation with the axle.

Additionally, a second flange defines a further periphery, the second flange being secured to the second extremity of the axle for rotation with the axle. Also, the flanges are disposed between the walls.

Furthermore, a plurality of sponge squeezing members extend between the flanges. The sponge squeezing members are spaced relative to each other along and adjacent to the peripheries of the flanges. The arrangement is structured such that when the second roller rotates, the sponge squeezing members squeeze and condition the sponge.

The sponge engaging members and the sponge squeezing members cooperate together to drive the sponge through the passageway while alternately compressing and releasing the sponge for condition the sponge.

Also, a plurality of pairs of counter rotating rollers are rotatably supported between the walls for further defining the passageway. The pairs of rollers are positioned so that as the sponge progressively is driven from a pair of the rollers to an adjacent pair of rollers, the sponge is progressively washed and conditioned.

Additionally, a gear wheel is secured to the first roller and a further gear wheel is secured to the second roller.

A drive is connected to the gear wheels for driving the gear wheels in opposite rotational directions relative to each other so that the sponge is driven through the passageway.

Moreover, a geared wheel is secured to each roller respectively of the pairs of rollers so that each of the geared wheels are connected to the drive so that the rollers of each pair are counter rotated relative to each other so that the rollers progressively drive the sponge through the passageway for washing and conditioning the sponge in the water.

More particularly, the drive includes a manual crank for rotating the first and second rollers.

More specifically, the manual crank is provided for rotating the first and second rollers and the pairs of rollers.

In another embodiment of the present invention, the drive includes a motor for rotating the first and second rollers. The drive also includes a motor for rotating the first and second rollers and the pairs of rollers.

Additionally, each of the gear wheels and each of the geared wheels is intermeshed with an adjacent gear or geared wheel.

Furthermore, the passageway has a first and a second end, the sponge being placed adjacent to the first end of the passageway. Also, the cleaned and conditioned sponge exits from the apparatus adjacent the second end of the passageway.

In a variation of the present invention, a tile sponge washing and conditioning apparatus is provided for washing in water a sponge used during a ceramic tile grouting operation. The apparatus includes a flame for disposition thereof within the water. The flame has a first wall and a second wall disposed spaced from the first wall. A first roller has an axis of rotation which extends through the walls and a second roller has a rotational axis which also extends through the walls. The rollers cooperate with each other to define therebetween a downstream end of a passageway for the passage therethrough of the sponge. The apparatus is structured such that when the rollers are counter rotated relative to each other, the sponge is squeezed and driven through the downstream end of the passageway. A plurality of agitators are rotatably supported between the walls for further defining the passageway so that the sponge is progressively driven by the agitators along the passageway from an upstream end of the passageway towards the downstream end of the passageway so that the sponge is progressively washed and conditioned by the agitators and so that subsequently, the sponge is squeezed between the rollers.

More specifically, the tile sponge washing and conditioning apparatus further includes a motor for driving at least one of the rollers and at least one of the agitators. Additionally, the apparatus includes an intermeshing gear train which is driven by the motor. The gear train is connected to the at least one of the rollers and the at least one of the agitators for rotating the at least one of the rollers and the at least one of the agitators. The arrangement is such that when the motor is energized, the sponge is moved through the passageway from the upstream end towards the downstream end thereof for washing and conditioning the sponge and for squeezing the sponge between the rollers for removing water therefrom.

In one of the arrangements, the motor and the gear train are both disposed on a same side of the frame.

However, in another arrangement, the motor and the gear train are disposed on opposite sides of the frame for enhancing the stability of the apparatus.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
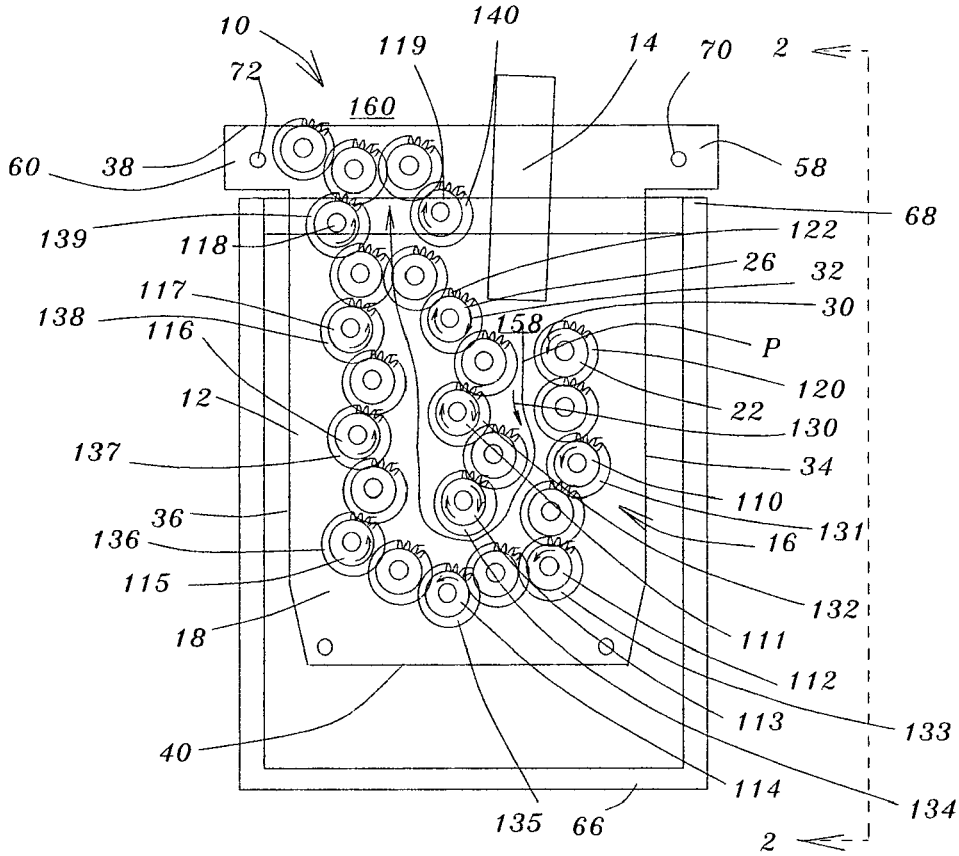
FIG. 1 is a side elevational view of a tile sponge washing and conditioning apparatus according to the present invention for washing in water a sponge used during a ceramic tile grouting operation.

FIG. 1 is a side elevational view of a tile sponge washing and conditioning apparatus generally designated 10 according to the present invention for washing in water 12 a sponge 14 used during a ceramic tile grouting operation. As shown in FIG. 1, the apparatus 10 includes a frame generally designated 16 for disposition thereof within the water 12. The frame 16 includes a first wall 18.

Figure 2:
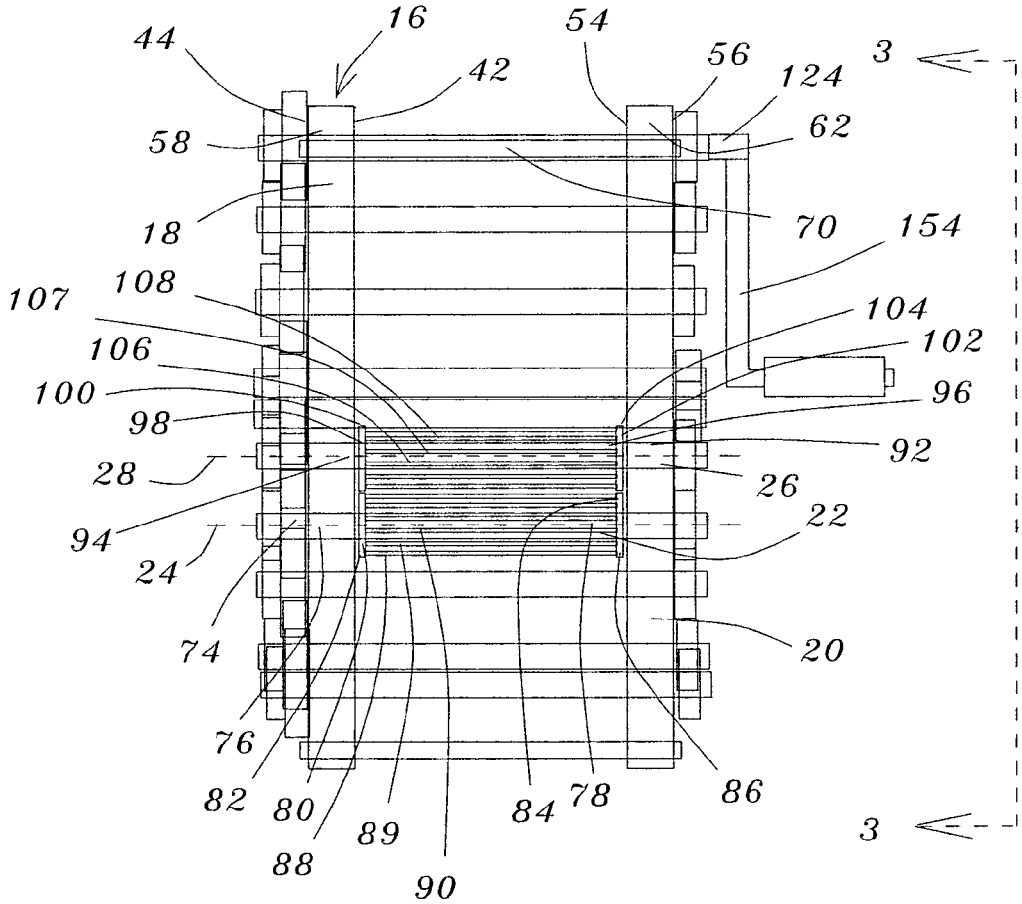
FIG. 2 is a view taken on the line 2-2 of FIG. 1.

FIG. 2 is a view taken on the line 2-2 of FIG. 1. As shown in FIG. 2, the frame 16 includes a second wall 20 which is disposed spaced from the first wall 18. A first roller generally designated 22 has an axis of rotation 24 which extends through the walls 18 and 20 respectively and a second roller generally designated 26 has a rotational axis 28 which also extends through the walls 18 and 20 respectively. As shown in FIG. 1, the rollers 22 and 26 cooperate with each other to define therebetween a pathway indicated by the arrow P for the passage therethrough of the sponge 14 to be washed and conditioned. The arrangement is such that when the rollers 22 and 26 are counter rotated relative to each other as indicated by the arrows 30 and 32 respectively, the sponge 14 is squeezed and driven through the passageway P so that the sponge 14 is washed and conditioned by the water 12 during passage of the sponge 14 through the passageway P.

In a more specific embodiment of the present invention, the frame 16 is fabricated from stainless steel.

Also, as shown in FIG. 1, the first wall 18 is of planar configuration, the first wall 18 having a first and a second edge 34 and 36 respectively, a top and a bottom edge 38 and 40 respectively.

As shown in FIG. 2, the wall 18 also has an inner and an outer surface 42 and 44 respectively.

Figure 3:
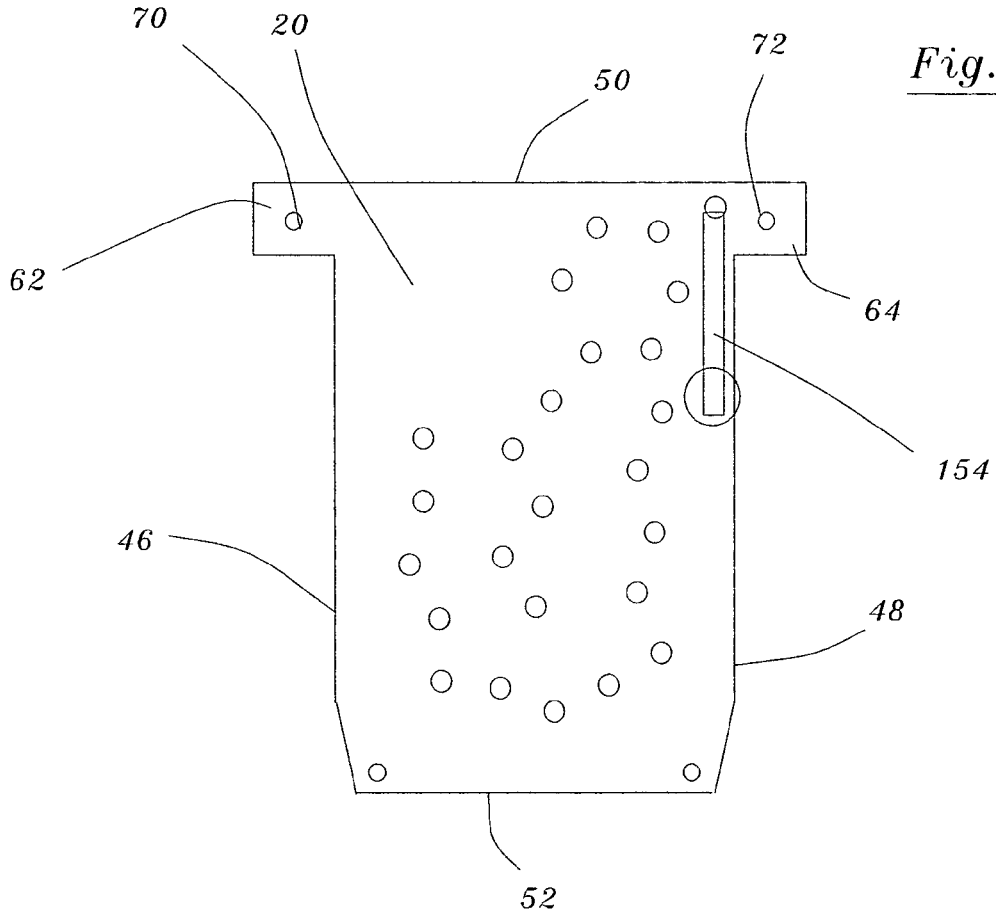
FIG. 3 is a view taken on the line 3-3 of FIG. 2.

FIG. 3 is a view taken on the line 3-3 of FIG. 2. As shown in FIG. 3, the second wall 20 is of planar configuration, the second wall 20 having a first and a second side 46 and 48 respectively and a top and a bottom end 50 and 52 respectively.

As shown in FIG. 2, the second wall 20 has an inner and an outer face 54 and 56 respectively, the second wall 20 being disposed parallel relative to the first wall 18.

More specifically, as shown in FIG. 1, the first wall 18 includes a first ear 58 which extends from the first edge 34. Also, a second ear 60 extends from the second edge 36.

As shown in FIG. 3, the second wall 20 includes a first extension 62 which extends from the first side 46 and a second extension 64 which extends from the second side 48.

As shown in FIG. 1, a container 66 is provided for containing the water 12. The container 66 defines a rim 68 for supporting the ears 58 and 60 respectively and the extensions 62 and 64 respectively such that when the ears 58 and 60 and extensions 62 and 64 are being supported by the rim 68, the rollers 22 and 26 respectively are disposed within the water 12 contained within the container 66.

Additionally, as shown in FIG. 2, the frame 16 includes a first reinforcing member 70 which extends between the first ear 58 and the first extension 62. As shown in FIG. 1, a second reinforcing member 72 extends between the second ear 60 and the second extension 64 such that the reinforcing members 70 and 72 respectively maintain the first and second walls 18 and 20 in a spaced parallel disposition relative to each other.

As shown in FIG. 2, the first roller 22 includes a hub 74 which is disposed coaxially relative to the axis of rotation 24. The hub 74 extends through the walls 18 and 20 respectively such that the walls 18 and 20 respectively bearingly support the hub 74 for rotation of the hub 74 relative to the walls 18 and 20. Also, the hub 74 has a first and a second end 76 and 78 respectively.

More particularly, a first collar 80 defines a peripheral edge 82, the first collar 80 being secured to the first end 76 of the hub 74 for rotation with the hub 74.

Also, a second collar 84 defines a further peripheral edge 86, the second collar 84 being secured to the second end 78 of the hub 74 for rotation with the hub 74. Moreover, the collars 80 and 84 respectively are disposed between the walls 18 and 20 respectively.

A plurality of sponge engaging members 88, 89 and 90 extend between the collars 80 and 84 respectively. The sponge engaging members 88-90 are spaced relative to each other around and adjacent to the peripheral edges 82 and 86 respectively of the collars 80 and 84 respectively. The arrangement is such that when the first roller 22 rotates, the sponge engaging members 88-90 squeeze and condition the sponge 14.

Additionally, the second roller 26 includes an axle 92 which is disposed coaxially relative to the rotational axis 28. The axle 92 extends through the walls 18 and 20 respectively such that the walls 18 and 20 respectively bearingly support the axle 92 for rotation of the axle 92 relative to the walls 18 and 20. Also, the axle 92 has a first and a second extremity 94 and 96 respectively.

A first flange 98 of the axle 92 defines a periphery 100, the first flange 98 being secured to the first extremity 94 of the axle 92 for rotation with the axle 92.

Additionally, a second flange 102 defines a further periphery 104, the second flange 102 being secured to the second extremity 96 of the axle 92 for rotation with the axle 92. Also, the flanges 98 and 102 respectively are disposed between the walls 18 and 20.

Furthermore, a plurality of sponge squeezing members 106, 107 and 108 extend between the flanges 98 and 102 respectively. The sponge squeezing members 106-108 are spaced relative to each other around and adjacent to the peripheries 100 and 104 respectively of the flanges 98 and 102 respectively. The arrangement is structured such that when the second roller 26 rotates as indicated by the arrow 32 as shown in FIG. 1, the sponge squeezing members 106-108 squeeze and condition the sponge 14.

The sponge engaging members 88-90 and the sponge squeezing members 106-108 cooperate together to drive the sponge 14 through the passageway P while alternately compressing and releasing the sponge 14 for condition the sponge 14.

Also, as shown in FIG. 1, a plurality of pairs of counter rotating rollers 110 and 111, 112 and 113, 114 and 113, 115 and 113, 116 and 113, 116 and 111, 117 and 26, 118 and 119 are rotatably supported between the walls 18 and 20 for further defining the passageway P. The pairs of rollers 110 and 111, 112 and 113, 114 and 113, 115 and 113, 116 and 113, 116 and 111, 117 and 26, 118 and 119 are positioned so that as the sponge 14 progressively is driven from a pair of the rollers such as 110 and 111 to an adjacent pair of rollers 112 and 113, the sponge 14 is progressively washed and conditioned.

Additionally, a gear wheel 120 is secured to the first roller 22 and a further gear wheel 122 is secured to the second roller 26.

As shown in FIG. 2, a drive generally designated 124 is connected to the gear wheels 120 and 122 for driving the gear wheels 120 and 122 in opposite rotational directions relative to each other as indicated in FIG. 1 by the arrows 30 and 32 respectively so that the sponge 14 is driven through the passageway P in the direction as indicated by the arrow 130.

Moreover, a geared wheel 131, 132, 133, 134, 135, 136, 137 138 139 and 140 is secured to each roller of the pairs of rollers 110 and 111, 112 and 113, 114 and 113, 115 and 113, 116 and 113, 116 and 111, 117 and 26, 118 and 119 so that each of the geared wheels 131-140 are connected to the drive 124 so that the rollers of each pair 110 and 111, 112 and 113,

114 and 113, 115 and 113, 116 and 113, 116 and 111, 117 and 26, 118 and 119 are counter rotated relative to each other so that the rollers 110 and 111, 112 and 113, 114 and 113, 115 and 113, 116 and 113, 116 and 111, 117 and 26, 118 and 119 progressively drive the sponge 14 through the passageway P for washing and conditioning the sponge 14 in the water. 12.

As shown in FIG. 1, reversing gears intermesh with the geared wheels 131-140 of the respective pairs of rollers 110 and 111, 112 and 113, 114 and 113, 115 and 113, 116 and 113, 116 and 111, 117 and 26, 118 and 119 so that all of the pairs of rollers 110 and 111, 112 and 113, 114 and 113, 115 and 113, 116 and 113, 116 and 111, 117 and 26, 118 and 119 and the first and second rollers 22 and 26 are driven in the directions indicated by the arrows by the drive 124.

More particularly, as shown in FIG. 3, the drive 124 includes a manual crank 154 for rotating the first and second rollers 22 and 26.

More specifically, the manual crank 154 is provided for rotating the first and second rollers 22 and 26 and the pairs of rollers 110 and 111, 112 and 113, 114 and 113, 115 and 113, 116 and 113, 116 and 111, 117 and 26, 118 and 119.

Figure 4:
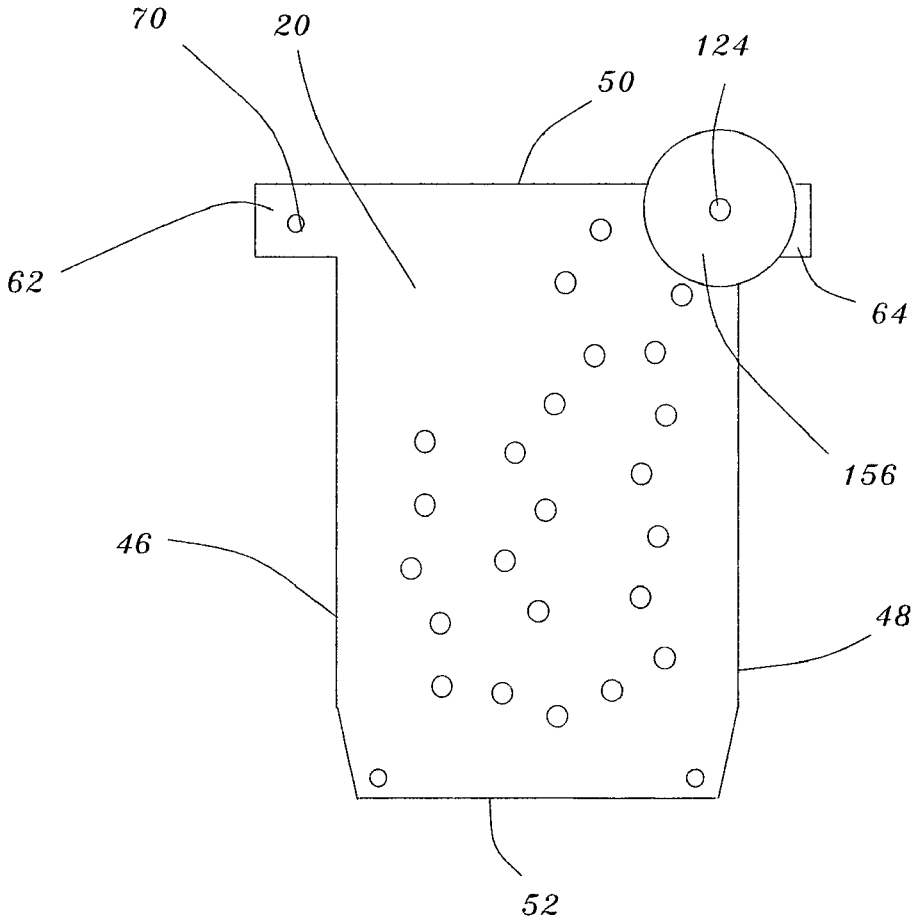
FIG. 4 is a similar view to that shown in FIG. 3 but shows an alternative embodiment of the present invention.

FIG. 4 is a similar view to that shown in FIG. 3 but shows an alternative embodiment of the present invention. As shown in FIG. 4, the drive 124 includes a motor 156 for rotating the first and second rollers 22 and 26 respectively. The motor 156 which may be an electric motor which has a transformer for connection to a mains supply. The motor 156 is provided for rotating the first and second rollers 22 and 26 and the pairs of rollers 110 and 111, 112 and 113, 114 and 113, 115 and 113, 116 and 113, 116 and 111, 117 and 26, 118 and 119.

Additionally, each of the gear wheels 120 and 122 and each of the geared wheels 131-140 is intermeshed with an adjacent wheel.

Furthermore, as shown in FIG. 1, the passageway P has a first and a second end 158 and 160 respectively, the sponge 14 being placed adjacent to the first end 158 of the passageway P. Also, the cleaned and conditioned sponge 14 exits from the apparatus 10 adjacent the second end 160 of the passageway P.

In operation of the apparatus according to the present invention, a sponge 14 that has been used for removing excess grout from freshly laid tiles is placed between the rollers at the first end 158 of the passageway P so that as the pairs of cooperating rollers rotate, the sponge 14 is progressively squeezed and released in the water within the container so that when the sponge emerges from the pathway P, the sponge is clean and reconditioned and ready for use in the removal of further excess grout from the tiles.

Figure 5:
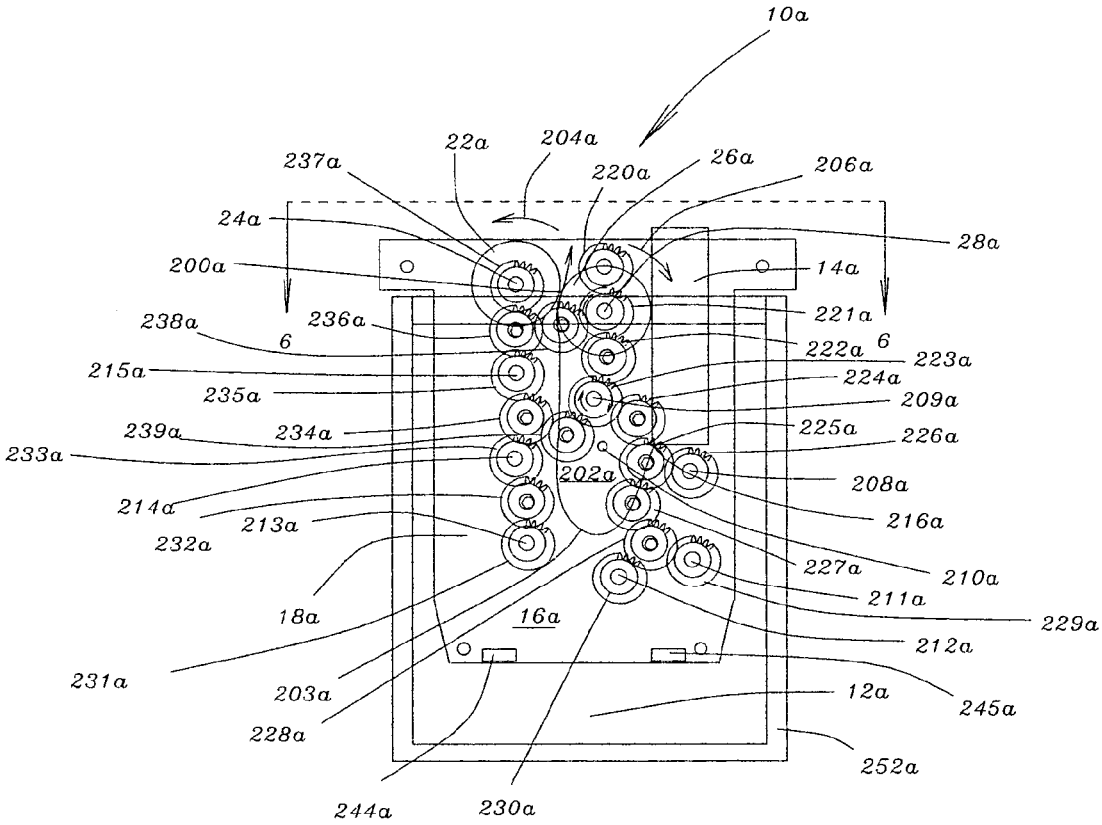
FIG. 5 is a side elevational view of a variation of the present invention.

FIG. 5 is a side elevational view of a variation of the present invention. As shown in FIG. 5, a tile sponge washing and conditioning apparatus 10*a* is used for washing in water 12*a* a sponge 14*a* used during a ceramic tile grouting operation. The apparatus 10*a* includes a frame 16*a* for disposition thereof within the water 12*a*. The frame has a first wall 18*a*.

Figure 6:
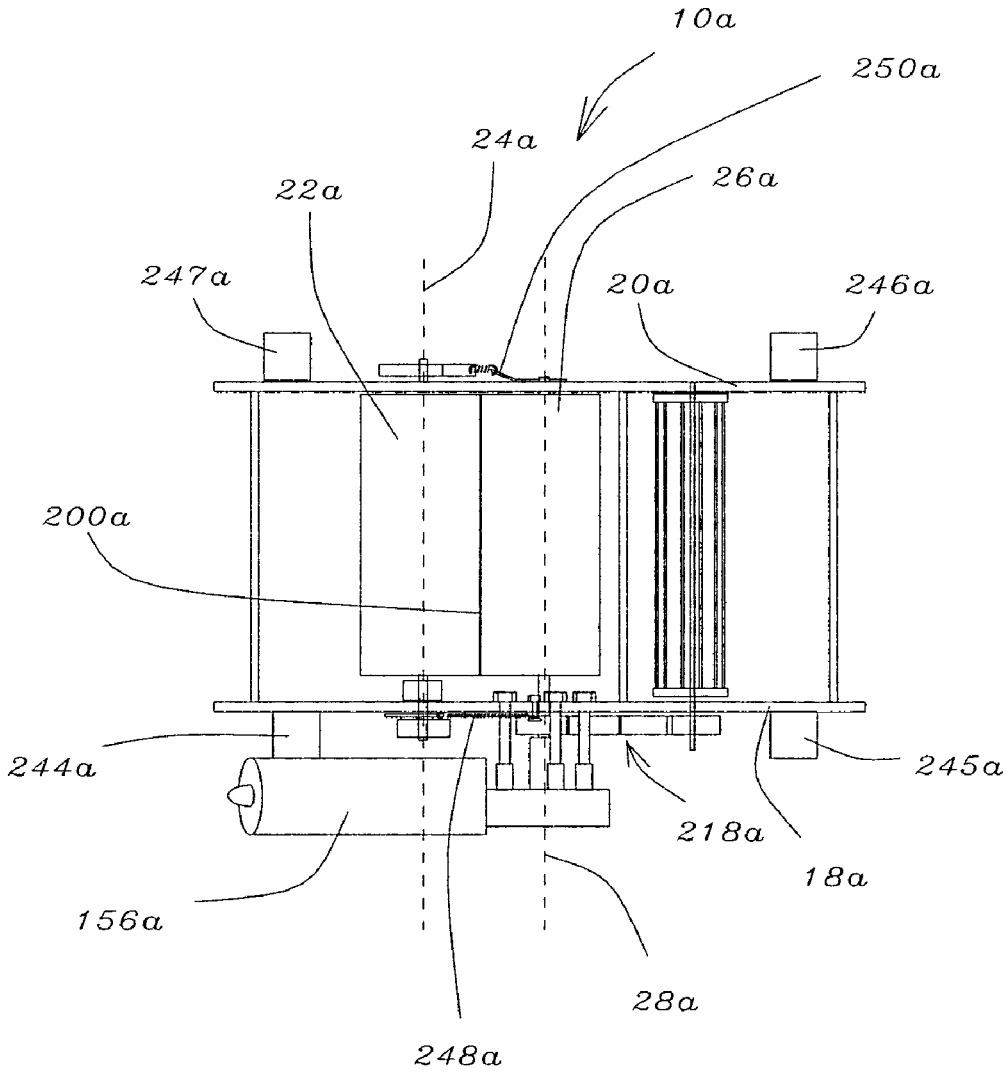
FIG. 6 is a view taken on the line 6-6 of FIG. 5.

FIG. 6 is a view taken on the line 6-6 of FIG. 5. As shown in FIG. 6, the frame 16*a* includes a second wall 20*a* which is disposed spaced from the first wall 18*a*. A first roller 22*a* has an axis of rotation 24*a* which extends through the walls 18*a* and 20*a*. A second roller 26*a* has a rotational axis 28*a* which also extends through the walls 18*a* and 20*a*. The rollers 22*a* and 26*a* cooperate with each other to define therebetween a downstream end 200*a* of a passageway 202*a* for the passage therethrough of the sponge 14*a* as indicated by the arrow 203*a* shown in FIG. 1. As shown in FIG. 1, the apparatus 10*a* is structured such that when the rollers 22*a* and 26*a* are counter rotated relative to each other as indicated by the arrows 204*a* and 206*a*, the sponge 14*a* is squeezed and driven through the downstream end 200*a* of the passageway 202*a*. A plurality of agitators 208*a*, 209*a*, 210*a*, 211*a*, 212*a*, 213*a*, 214*a* and 215*a* are rotatably supported between the walls 18*a* and 20*a* for further defining the passageway 202*a* so that the sponge 14*a* is progressively driven by the agitators 208*a* to 215*a* along the passageway 202*a* from an upstream end 216*a* of the passageway 202*a* towards the downstream end 200*a* of the passageway 202*a*. The arrangement is such that the sponge 14*a* is progressively washed and conditioned by the agitators 208*a* to 215*a* and so that subsequently, the sponge 14*a* is squeezed between the rollers 22*a* and 26*a*.

More specifically, as shown in FIG. 6, the tile sponge washing and conditioning apparatus 10*a* further includes a motor 156*a* for driving at least one of the rollers 22*a*, 26*a* such as roller 26*a* and at least one of the agitators. 208*a* to 215*a*. Additionally, the apparatus 10*a* includes an intermeshing gear train generally designated 218*a* which is driven by the motor 156*a*. As shown in FIG. 5, the gear train 218*a* which includes gears 220*a*, 221*a*, 222*a*, 223*a*, 224*a*, 225*a*, 226*a*, 227*a*, 228*a*, 229*a*, 230*a*, 231*a*, 232*a*, 233*a*, 234*a*, 235*a*, 236*a*, 237*a*, 238*a* and 239*a* is connected to the at least one of the rollers 22*a*, 26*a* and the at least one of the agitators 208*a* to 215*a* for rotating the at least one of the rollers 22*a*, 26*a* and the at least one of the agitators 208*a* to 215*a*. The arrangement is such that when the motor 156*a* is energized, the sponge 14*a* is moved through the passageway 202*a* from the upstream end 216*a* towards the downstream end 200*a* thereof as indicated by the arrow 203*a* for washing and conditioning the sponge 14*a* and for squeezing the sponge 14*a* between the rollers 22*a* and 26*a* for removing water therefrom.

As shown in FIG. 5, the upsteam end 216*a* of the passageway 202*a* is disposed relatively low down on the frame 16*a* so that a user's fingers are not accidently caught between the rotating agitators 208*a* to 215*a*. However, the apparatus 10*a* is structured such that if an object other than a sponge 14*a* is caught between rotating agitators, rotation of the agitators 208*a* to 215*a* and/or rollers 22*a*, 26*a* would stop. Also, an agitator 210*a* is freely rotatable and is not connected with the gear train 218*a*. The agitator 210*a* cooperates with the other agitators 208*a*, 209*a* and 211*a* to 215*a*.

Additionally, as shown in FIG. 6, the frame 16*a* includes outwardly extending legs 244*a*, 245*a* 246*a* and 247*a* which extend from the bottom of the frame to enhance the stability of the frame if the frame is resting on the bottom of a water filled sink or container.

Furthermore, As shown in FIG. 6, a first a second tension spring 248*a* and 250*a* are anchored at one end thereof to the frame 16*a* The other ends of the springs 248*a* and 250*a* are connected to the roller 22*a* for urging the first roller 22*a* against the second roller 26*a* for permitting the passage therethrough of the sponge 14*a*.

In the arrangement as shown in FIG. 5, the motor 156*a* and the gear train 218*a* are both disposed on a same side of the frame 16*a*.

As shown in FIG. 6, the motor 156*a* and the gear train 218*a* are disposed adjacent to the first wall 18*a*.

Figure 7:
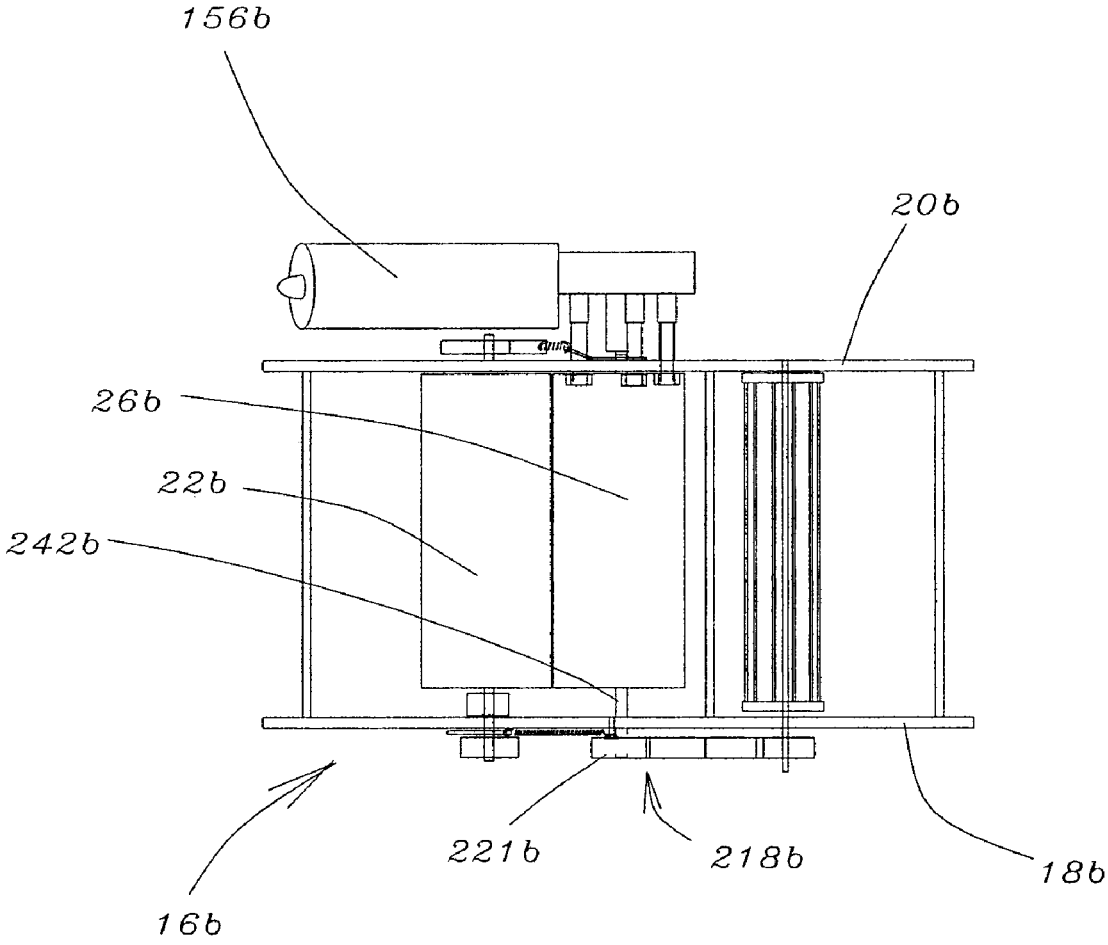
FIG. 7 is a similar view to that shown in FIG. 6 but shows another embodiment of the present invention.

FIG. 7 is a similar view to that shown in FIG. 6 but shows another embodiment of the present invention. As shown in FIG. 7, a motor 156*b* is disposed adjacent to the second wall 20*b* and the gear train 218*b* is disposed adjacent to the first wall 18*b* so that the gear train 218*b* is disposed on an opposite side of the frame generally designated 16*b* relative to the motor 156*b* for enhancing the stability of the apparatus 10*b*. The motor 156*b* is drivingly connected to one of the gears such as gear wheel 221*b* by means of a drive rod 242*b* which extends through one of the rollers 22*b*, 26*b*.

In operation of the apparatus shown in FIGS. 5-7, the frame 16*a* is located within a water filled sink or container 252*a* as shown in FIG. 5. The motor 156*a* is energized and a sponge 14*a* filled with used grouting is inserted at the upstream end 216*a* of the passageway 202*a* so that the sponge 14*a* is agitated by the agitators 208*a* to 215*a* as the sponge 14*a* is urged along the passageway 202*a* towards the rollers 22*a* and 26*a* so that the sponge 14*a* is squeezed during passage of the sponge 14*a* through a nip formed between the counter rotating rollers 22*a* and 26*a*. The cleaned and conditioned sponge 14*a* is then ready for further use in the tile grouting operation. It has been discovered that during experimental use of the apparatus 10*a*, the apparatus is capable of providing at least two tile grouting operators working simultaneously on a project with a sufficient supply of cleaned and reconditioned tile sponges.

The present invention provides a unique apparatus for washing and conditioning a grouting sponge which greatly reduces the time taken to complete a grouting project and which also protects the tiler's hands from excessive contact with the grout.

What is claimed is:

1. A tile sponge washing and conditioning apparatus for washing in water a sponge used during a ceramic tile grouting operation, said apparatus comprising:

a frame for disposition thereof within the water, said frame including:

a first wall;

a second wall disposed spaced from said first wall;

a first roller having an axis of rotation which extends through said walls;

a second roller having a rotational axis which extends through said walls;

said rollers cooperating with each other to define therebetween a pathway for the passage therethrough of the sponge to be washed and conditioned such that when said rollers are counter rotated relative to each other, the sponge is squeezed and driven through said passageway so that the sponge is washed and conditioned by the water during passage of the sponge through said passageway;

said rollers cooperating with each other to define therebetween a downstream end of said passageway for the passage therethrough of the sponge, the apparatus being structured such that when said rollers are counter rotated relative to each other, the sponge is squeezed and driven through said downstream end of said passageway;

a plurality of agitators rotatably supported between said walls for further defining said passageway so that the sponge is progressively driven by said agitators along said passageway from an upstream end of said passageway towards said downstream end of said passageway so that the sponge is progressively washed and conditioned by said agitators and so that subsequently, the sponge is squeezed between said rollers;

said frame being fabricated from stainless steel;

a first ear which extends from said first edge;

a second ear which extends from said second edge;

said second wall includes:

a first extension which extends from said first side;

a second extension which extends from said second side;

a container for containing the water, said container defining a rim for supporting said ears and said extensions such that when said ears and extensions are being supported by said rim, said rollers are disposed within the water contained within said container;

said frame including:

a first reinforcing member which extends between said first ear and said first extension; and a second reinforcing member which extends between said second ear and said second extension such that said reinforcing members maintain said first and second walls in a spaced parallel disposition relative to each other.

2. A tile sponge washing and conditioning apparatus as set forth in claim 1 wherein said first wall is of planar configuration said first wall having a first and a second edge, a top and a bottom edge and an inner and an outer surface;

said second wall is of planar configuration said second wall having a first and a second side, a top and a bottom end and an inner and an outer face, said second wall being disposed parallel relative to said first wall.

3. A tile sponge washing and conditioning apparatus as set forth in claim 1 further including:

a plurality of pairs of counter rotating rollers rotatably supported between said walls for further defining said passageway so that as the sponge progressively is driven from a pair of said rollers to an adjacent pair of rollers, the sponge is progressively washed and conditioned.

4. A tile sponge washing and conditioning apparatus as set forth in claim 1 further including:

a gear wheel secured to said first roller;

a further gear wheel secured to said second roller;

a drive connected to said gear wheels for driving said gear wheels in opposite rotational directions relative to each other so that the sponge is driven through said passageway.

5. A tile sponge washing and conditioning apparatus as set forth in claim 4 wherein said drive includes:

a manual crank for rotating said first and second rollers.

6. A tile sponge washing and conditioning apparatus as set forth in claim 4 wherein said drive includes:

a motor for rotating said first and second rollers.

7. A tile sponge washing and conditioning apparatus as set forth in claim 1 further including:

a plurality of pairs of counter rotating rollers rotatably supported between said walls for further defining said passageway so that as the sponge progressively is driven from a pair of said rollers to an adjacent pair of rollers, the sponge is progressively washed and conditioned;

a gear wheel secured to said first roller;

a further gear wheel secured to said second roller;

a drive connected to said gear wheels for driving said gear wheels in opposite rotational directions relative to each other so that the sponge is driven through said passageway;

a geared wheel secured to each roller respectively of said pairs of rollers so that each of said geared wheels is connected to said drive such that said rollers of each pair are counter rotated relative to each other so that said rollers progressively drive the sponge through said passageway for washing and conditioning the sponge in the water.

8. A tile sponge washing and conditioning apparatus as set forth in claim 7 wherein said drive includes:

a manual crank for rotating said first and second rollers and said pairs of rollers.

9. A tile sponge washing and conditioning apparatus as set forth in claim 7 wherein said drive includes:

a motor for rotating said first and second rollers and said pairs of rollers.

10. A tile sponge washing and conditioning apparatus as set forth in claim 7 wherein each of said gear wheels and each of said geared wheels is intermeshed with an adjacent wheel.

11. A tile sponge washing and conditioning apparatus as set forth in claim 1 wherein said passageway has a first and a second end, the sponge being placed adjacent to said first end of said passageway and the cleaned and conditioned sponge exiting from said apparatus adjacent said second end of said passageway.

12. A tile sponge washing and conditioning apparatus as set forth in claim 1 further including:

a motor for driving at least one of said rollers and at least one of said agitators.

13. A tile sponge washing and conditioning apparatus as set forth in claim 1 further including:

an intermeshing gear train driven by said motor, said gear train being connected to said at least one of said rollers and said at least one of said agitators for rotating said at least one of said rollers and said at least one of said agitators, so that when said motor is energized, the sponge is moved through said passageway from said upstream end towards said downstream end thereof for washing and conditioning the sponge and for squeezing the sponge between said rollers for removing water therefrom.

14. A tile sponge washing and conditioning apparatus as set forth in claim 13 wherein said motor and said gear train are both disposed on a same side of said frame.

15. A tile sponge washing and conditioning apparatus as set forth in claim 13 wherein said motor and said gear train are disposed on opposite sides of said frame for enhancing the stability of said apparatus.

16. A tile sponge washing and conditioning apparatus for washing in water a sponge used during a ceramic tile grouting operation, said apparatus comprising:

a frame for disposition thereof within the water, said frame including:

a first wall;

a second wall disposed spaced from said first wall;

a first roller having an axis of rotation which extends through said walls;

a second roller having a rotational axis which extends through said walls;

said rollers cooperating with each other to define therebetween a pathway for the passage therethrough of the sponge to be washed and conditioned such that when said rollers are counter rotated relative to each other, the sponge is squeezed and driven through said passageway so that the sponge is washed and conditioned by the water during passage of the sponge through said passageway;

said rollers cooperating with each other to define therebetween a downstream end of said passageway for the passage therethrough of the sponge, the apparatus being structured such that when said rollers are counter rotated relative to each other, the sponge is squeezed and driven through said downstream end of said passageway;

a plurality of agitators rotatably supported between said walls for further defining said passageway so that the sponge is progressively driven by said agitators along said passageway from an upstream end of said passageway towards said downstream end of said passageway so that the sponge is progressively washed and conditioned by said agitators and so that subsequently, the sponge is squeezed between said rollers;

said first roller includes:

a hub disposed coaxially relative to said axis of rotation, said hub extending through said walls such that said walls bearingly support said hub for rotation of said hub relative to said walls, said hub having a first and a second end;

a first collar defining a peripheral edge, said first collar being secured to said first end of said hub for rotation with said hub;

a second collar defining a further peripheral edge, said second collar being secured to said second end of said hub for rotation with said hub, said collars being disposed between said walls;

a plurality of sponge engaging members extending between said collars, said sponge engaging members being spaced relative to each other along and adjacent to said peripheral edges of said collars such that when said first roller rotates, said sponge engaging members squeeze and condition the sponge;

said second roller includes:

an axle disposed coaxially relative to said rotational axis, said axle extending through said walls such that said walls bearingly support said axle for rotation of said axle relative to said walls, said axle having a first and a second extremity;

a first flange defining a periphery, said first flange being secured to said first extremity of said axle for rotation with said axle;

a second flange defining a further periphery, said second flange being secured to said second extremity of said axle for rotation with said axle, said flanges being disposed between said walls;

a plurality of sponge squeezing members extending between said flanges, said sponge squeezing members being spaced relative to each other along and adjacent to said peripheries of said flanges such that when said second roller rotates, said sponge squeezing members squeeze and condition the sponge;

said sponge engaging members and said sponge squeezing members cooperating together to drive the sponge through said passageway while alternately compressing and releasing the sponge for condition the sponge.

* * * * *